US008225933B2

(12) United States Patent
Wade

(10) Patent No.: US 8,225,933 B2
(45) Date of Patent: Jul. 24, 2012

(54) INNER FRAME STIFFENER FOR BLISTER CARD PACKAGING

(75) Inventor: Michael Wade, Chesterfield, VA (US)

(73) Assignee: MeadWestvac Corporation, Richmond, VA (US)

( * ) Notice: Subject to any disclaimer, the term of this patent is extended or adjusted under 35 U.S.C. 154(b) by 166 days.

(21) Appl. No.: 12/058,851

(22) Filed: Mar. 31, 2008

(65) Prior Publication Data

US 2008/0237081 A1 Oct. 2, 2008

Related U.S. Application Data

(60) Provisional application No. 60/920,623, filed on Mar. 29, 2007.

(51) Int. Cl.
*B65D 83/04* (2006.01)
*B65D 85/42* (2006.01)
*B65D 1/09* (2006.01)

(52) U.S. Cl. ..... 206/528

(58) Field of Classification Search ..... 206/528, 206/531
See application file for complete search history.

(56) References Cited

U.S. PATENT DOCUMENTS

| | | | | |
|---|---|---|---|---|
| 5,109,984 | A * | 5/1992 | Romick | 206/531 |
| 5,908,111 | A * | 6/1999 | Purdy | 206/461 |
| 6,161,699 | A * | 12/2000 | Gartland | 206/531 |
| 6,726,015 | B2 * | 4/2004 | Hulick | 206/531 |
| 2004/0040881 | A1 * | 3/2004 | Grosskopf | 206/538 |
| 2004/0121127 | A1 * | 6/2004 | Jokela et al. | 428/178 |
| 2006/0289328 | A1 * | 12/2006 | Hession | 206/531 |
| 2007/0062836 | A1 * | 3/2007 | Nazari | 206/461 |
| 2007/0125666 | A1 * | 6/2007 | Nazari | 206/45.24 |
| 2007/0137789 | A1 * | 6/2007 | Jokela et al. | 156/325 |
| 2007/0151893 | A1 * | 7/2007 | Barndt et al. | 206/531 |
| 2008/0105587 | A1 * | 5/2008 | Hawes et al. | 206/532 |

FOREIGN PATENT DOCUMENTS

| | | | |
|---|---|---|---|
| GB | 2218072 | A | 11/1989 |
| WO | WO2007133909 | A2 | 11/2007 |

OTHER PUBLICATIONS

WO2008121923 International Search Report, published Oct. 9, 2008.

International Preliminary Report on Patentability, published Sep. 29, 2009.

* cited by examiner

*Primary Examiner* — Mickey Yu
*Assistant Examiner* — Rafael Ortiz
(74) *Attorney, Agent, or Firm* — MWV Intellectual Property Group

(57) ABSTRACT

A blister card package structure with increased support comprising a first card having an inner surface and an outer surface, the first card defining an outer edge, a second card having an inner surface and an outer surface, the second card defining an opening therein and an outer edge, a blister having a body portion and a flange, wherein the body portion extends through the opening in the second card, and wherein the flange is positioned between the inner surfaces of the first and second cards, and an inner frame stiffener positioned between the inner surfaces of the first and second cards, wherein the inner surface of the first card is sealingly connected to the inner surface of the second card along the outer edges of the first and second cards.

26 Claims, 2 Drawing Sheets

INNER FRAME STIFFENER FOR BLISTER CARD PACKAGING

This application claims priority to U.S. Provisional Application Ser. No. 60/920,623 filed on Mar. 29, 2007, the entire contents of which are hereby incorporated by reference.

BACKGROUND

The present application is directed to blister card packaging structures and, more particularly, to trap sealing blister card packaging structures incorporating an inner frame stiffener.

Various consumer goods, such as pharmaceuticals, software, electronics, health and beauty products and the like, may be packaged in trap sealing blister packages. Trap sealing blister packages traditionally have been formed by sealing a flanged blister between two cards. The cards often are provided with a printable surface marked with various indicia.

For security and aesthetic reasons, the cards typically are formed from relatively high gauge, heavy weight materials, such as paperboard. However, the use of such high gauge, heavy weight materials may substantially increase the cost of trap sealing blister packages.

Accordingly, there is a need for a blister card packaging structure capable of meeting security and aesthetic requirements while providing reduced costs.

SUMMARY

In one aspect, the disclosed blister card packaging structure may include a first card having an inner surface and an outer surface, the first card defining an outer edge, a second card having an inner surface and an outer surface, the second card defining an opening therein and an outer edge, a blister having a body portion and a flange, wherein the body portion extends through the opening in the second card, and wherein the flange is positioned between the inner surfaces of the first and second cards, and an inner frame stiffener positioned between the inner surfaces of the first and second cards, the inner frame stiffener being formed from recycled chip board and/or paperboard, wherein the inner surface of the first card is sealingly connected to the inner surface of the second card along the outer edges of the first and second cards.

Other aspects of the disclosed blister card packaging structure will become apparent from the following description and the accompanying drawings.

DETAILED DESCRIPTION

Figure 1:
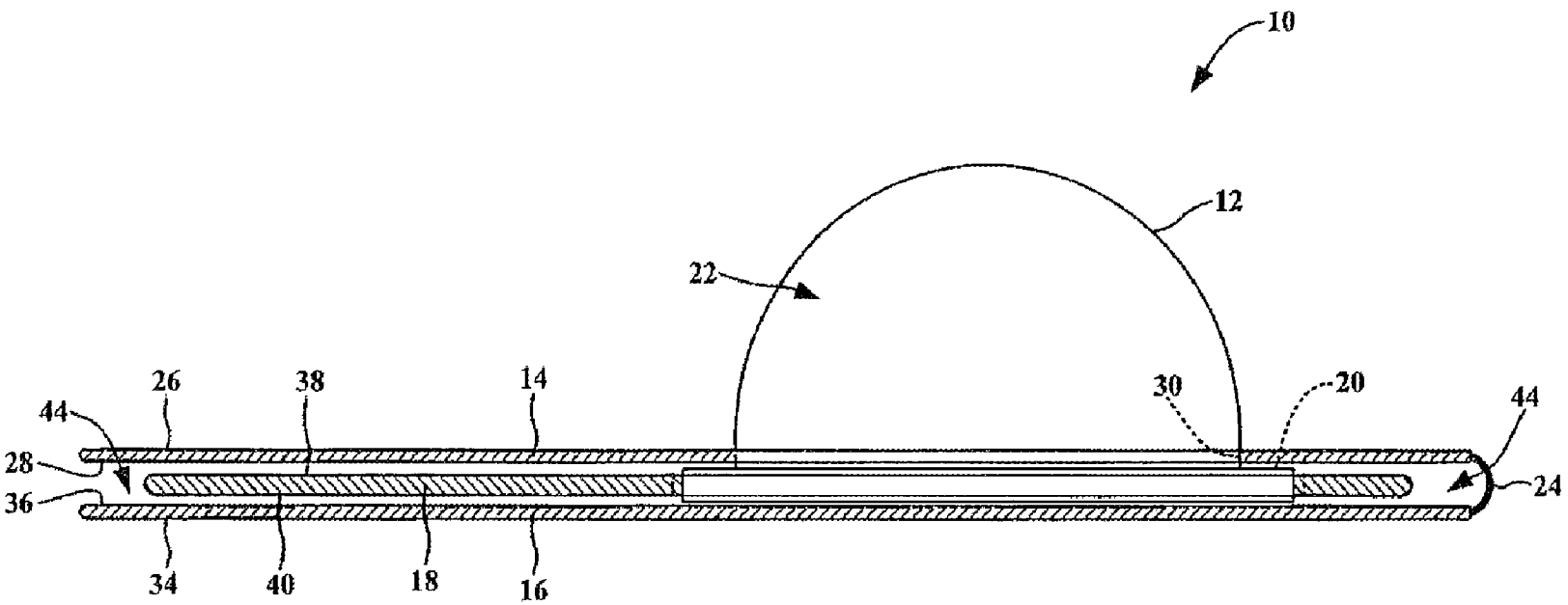
FIG. 1 is side elevational view of one aspect of the disclosed blister card packaging structure shown in an assembled configuration just prior to sealing.

Referring to FIG. 1, one aspect of the disclosed blister card packaging structure, generally designated 10, may include a blister 12, a front card 14, a rear card 16 and an inner frame stiffener 18. In the assembled configuration, the inner frame stiffener 18 may be positioned between the front and rear cards 14, 16 to provided structural support to the packaging structure 10.

The blister 12 may include a flange 20 and a body portion 22. The body portion 22 may define a storage chamber in which various items, such as consumer goods, may be received. Those skilled in the art will appreciate that the body portion 22 may be formed in various shapes, such as a hemispherical bubble (shown in FIG. 1), a rectangular box or other regular or irregular shapes. The shape and size of the body portion 22 of the blister 12 may be dictated by the items to be packaged in the packaging structure 10.

Figure 2:
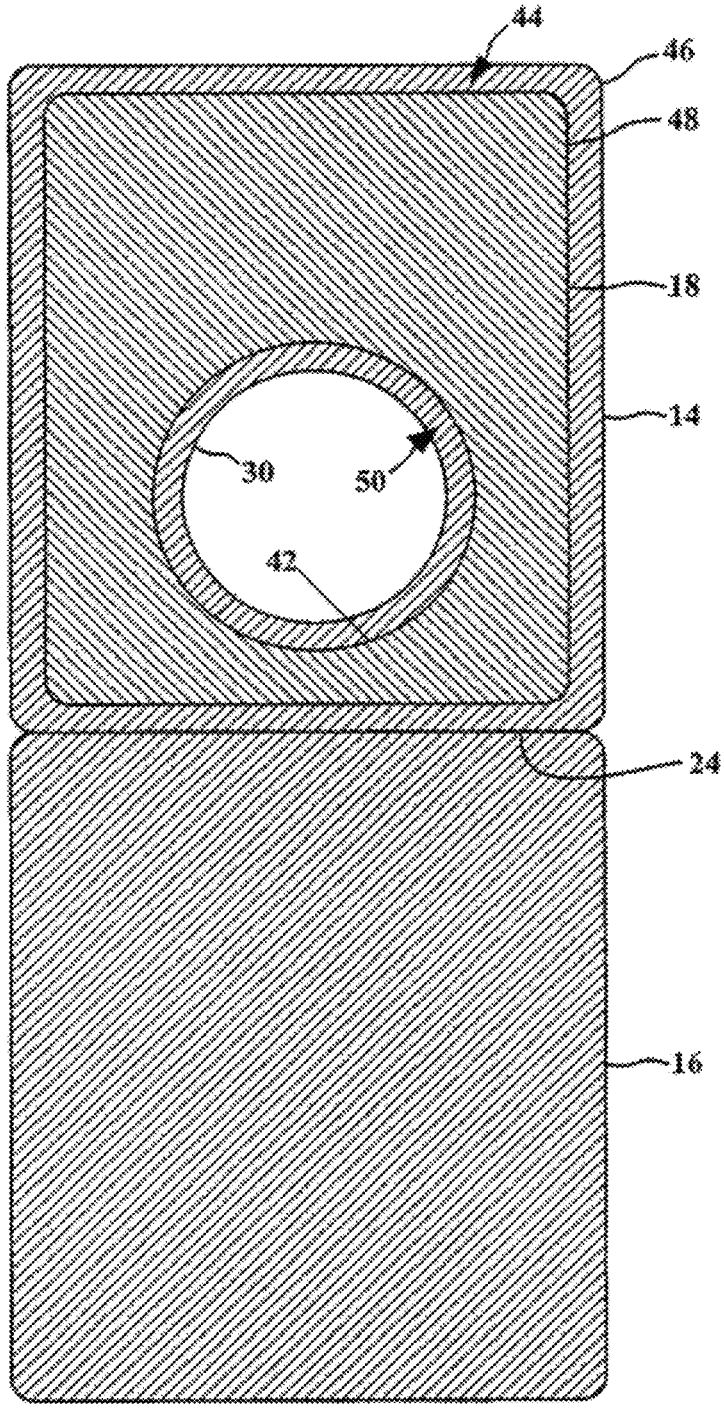
FIG. 2 is a top plan view of an inner frame stiffener positioned on a card portion of disclosed blister packaging structure of FIG. 1.

As shown in FIG. 2, the front and rear cards 14, 16 may be formed from a single continuous piece of material and may be separated by a fold line 24. Alternatively, the front and rear cards 14, 16 may be formed as separate pieces (not shown). For example, the cards 14, 16 may be formed by die cutting a bulk supply sheet, though those skilled in the art will appreciate that any available means for forming cards 14, 16 may be used.

Furthermore, while the front and rear cards 14, 16 are shown in FIG. 1 as defining a generally rectangular periphery in top view, those skilled in the art will appreciate that the front and rear cards 14, 16 may be formed into various sizes and shapes depending upon the application of the packaging structure 10.

Referring to FIGS. 1 and 2, the front card 14 may include an outer surface 26 and an inner surface 28 (FIG. 1) and may define an opening 30 (FIG. 2) therein sized and shaped to receive the body portion 22 of the blister 12 therethrough, while preventing the flange 20 of the blister 12 from passing therethrough. The rear card 16 may include an outer surface 34 and an inner surface 36. Optionally, a hanger notch (not shown) may be formed in the front and/or rear cards 14, 16 to facilitate hanging the assembled packaging structure 10 on a retail display rack (not shown).

The front and rear cards 14, 16 may be formed from any conventional blister package substrate such as a paperboard substrate. Examples of suitable paperboard substrates include solid bleached sulfate (SBS), folding boxboard and recycled board, whether bleached or unbleached. For example, the front and rear cards 14, 16 may be formed from or may include a SBS board having a thickness of about 10 to about 30 points. However, upon reading the present disclosure, those skilled in the art will appreciate that since the structure 10 is being formed with an inner frame stiffener 18, lighter weight and/or smaller gauge substrates may be used for the front and rear cards 14, 16, thereby reducing manufacturing costs without sacrificing security and aesthetics.

The outer surfaces 26, 34 of the front and rear cards 14, 16 may be coated with a printable coating selected for compatibility with the desired printing method and the selected substrate from which the front and rear cards 14, 16 are formed. For example, the outer surfaces 26, 34 of the front and rear cards 14, 16 may be coated with clay, calcium carbonate or combinations thereof.

The inner surfaces 28, 36 of the front and rear cards 14, 16 may be coated with a sealing material. The sealing material may be any material that may form a seal between the inner surfaces 28, 36 of the front and rear cards 14, 16. In one aspect, the sealing material may be an adhesive (e.g., a pressure sensitive adhesive or a curable adhesive). In another aspect, the sealing material may be a material that melts and seals to adjacent substrates or layers upon the application of heat, radio frequency energy and/or ultrasonic energy. Examples of useful sealing materials include ethylene vinyl acetate (EVA), ethylene methyl acrylate (EMA), copolymers of EVA and EMA, and combinations of EVA and/or EMA and other polymers or materials, low density polyethylene, high density polyethylene, linear low density polyethylene, ethylene acrylic acid, ethylene methacrylate, ethylene ethyl acrylate and ethylene n-butyl acrylate.

Those skilled in the art will appreciate that the front and/or rear cards 14, 16 may include additional layers or materials without departing from the scope of the present disclosure. For example, the front and/or rear cards 14, 16 may include a tear resistant layer or material (e.g., an oriented film layer) to provide improved package security.

As shown in FIGS. 1 and 2, the inner frame stiffener 18 may be a card or blank having a first surface 38 and a second surface 40 and may define an opening 42 therein. The inner frame stiffener 18 may be cut or otherwise shaped to be positioned between the front and rear cards 14, 16 to provide structural support to the assembled and sealed packaging structure 10.

Referring to FIG. 2, the inner frame stiffener 18 may be sized and shaped to provide a first sealing edge 44 between the outer edge 46 of the front and rear cards 14, 16 and the outer edge 48 of the inner frame stiffener 18. Therefore, the inner surface 28 of the front card 14 may sealingly engage the inner surface 36 of the rear card 16 along the first sealing edge 44 of the packaging structure 10. Furthermore, the opening 42 in the inner frame stiffener 18 may be sized and shaped to provide a second sealing edge 50 between the edge of the opening 30 in the front card 14 and the edge of the opening 42 in the inner frame stiffener 18. Therefore, the inner surface 28 of the front card 14 may sealingly engage the inner surface 36 of the rear card 16 along the second sealing edge 50 of the packaging structure 10.

In one aspect, the inner frame stiffener 18 may have a shape or profile in top view that closely resembles the shape or profile of the front and/or rear cards 14, 16. For example, as shown in FIG. 2, when the front and rear cards 14, 16 are generally rectangular in top view, the inner frame stiffener 18 may also be generally rectangular in top view, though somewhat smaller to provide the first sealing edge 44 between the outer edge 48 of the inner frame stiffener 18 and the outer edge 46 of the front and rear cards 14, 16.

The inner frame stiffener 18 may be formed from various paper-based materials, such as recycled chip board or paperboard, having various thicknesses and weights. For example, the inner frame stiffener 18 may have a thickness of about 40 to about 60 points. However, those skilled in the art will appreciate that the thickness and/or weight of the inner frame stiffener 18 may be selected based upon the thickness and/or weight of the front and rear cards 14, 16 and the desired overall thickness and/or rigidity of the assembled packaging structure 10.

Referring again to FIG. 1, the packaging structure 10 may be formed by (1) positioning the inner frame stiffener 18 between the front and rear cards 14, 16 such that the first surface 38 of the inner frame stiffener 18 is aligned with the inner surface 28 of the front card 14 and the second surface 40 of the inner frame stiffener 18 is aligned with the inner surface 36 of the rear card 16, thereby forming the first and second sealing edges 44, 50, (2) positioning the body portion 22 of the blister 12 through the opening 30 in the front card 14 such that the flange 20 of the blister 12 is positioned between the inner surfaces 28, 36 of the front and rear cards 14, 16, (3) positioning an item (e.g., a consumer good) into the body portion 22 of the blister 12, and (4) applying heat, radio frequency energy, ultrasonic energy, microwave energy, mechanical pressure and/or an adhesive to the first and second sealing surfaces 44, 50 to seal the front card 14 to the rear card 16.

Accordingly, those skilled in the art will appreciate that incorporating an inner frame stiffener 18 into the disclosed blister card packaging structure 10 may allow for the use of lighter weight and/or smaller gauge cards 14, 16, which may reduce manufacturing costs without compromising the structural integrity of the packaging structure 10.

Furthermore, the use of recycled chip board as the inner frame stiffener 18 has presented a substantial and unexpected advantage when the packaging structure 10 is sealed using a heat sealing process. Specifically, it has been discovered that the steam generated during the heat sealing process may be absorbed by the recycled chip board of the inner frame stiffener 18, thereby eliminating blister formation during heat sealing. Blister formation is a common defect associated with heat sealing of paperboard-based materials and may add substantial cost to packaging operations. Therefore, in addition to reducing materials costs, the disclosed packaging structure 10 may reduced costs associated with blister formation and/or provide a more aesthetically pleasing packaging structure.

Although various aspects of the disclosed blister card packaging structure have been shown and described, modifications may occur to those skilled in the art upon reading the specification.

What is claimed is:

1. A packaging structure comprising: a first card having an inner surface and an outer surface, said first card defining an outer edge; a second card having an inner surface and an outer surface, said second card defining an opening therein and an outer edge; an inner frame stiffener positioned between said inner surfaces of said first and said second cards, a blister having a body portion, wherein the body portion defines a storage chamber, and the blister having a flange, which flange is entirely received in an opening of the inner frame stiffener.

2. The packaging structure of claim 1, wherein the blister has a body portion that is a hemispherical bubble.

3. The packaging structure of claim 1, wherein said inner surface of said first card is sealingly connected to said inner surface of said second card along said outer edges of said first and second cards.

4. The packaging structure of claim 3, wherein the inner frame stiffener is designed to provide the first sealing edge.

5. The packaging structure of claim 1, wherein the second card is the front card, wherein the front card has an opening therein, and wherein the body portion of the blister extends through said opening in the front card.

6. The packaging structure of claim 5, wherein the blister has a flange portion and wherein the flange portion is unable to pass through said opening in said front card.

7. The packaging structure of claim 5, wherein the inner frame stiffener has an opening therein and the opening of the inner frame stiffener provides a second sealing edge between the edge of the opening of the second card and the edge of the opening of the inner frame stiffener.

8. The packaging structure of claim 1, wherein said inner frame stiffener has the same shape or profile as the first card.

9. The packaging structure of claim 1, wherein said inner frame stiffener has the same shape or profile as the second card.

10. The packaging structure of claim 1, wherein the first card and second card are formed of a continuous piece of material.

11. The packaging structure of claim 10, wherein the first card and second card are separated by a fold line.

12. The packaging structure of claim 1, wherein the first and second card form a generally rectangular shape.

13. The packaging structure of claim 1, wherein the first card and second card are made of SBS board.

14. The packaging structure of claim 13, wherein the SBS board has a thickness of 10 to 30 points.

15. The packaging structure of claim 1, wherein the outer surface of the first card and second card are coated with a sealing material.

16. The packaging structure of claim 15, wherein the sealing material is an adhesive.

17. The packaging structure of claim 1, wherein the outer surfaces of the first card and second card are coated with a printable coating.

18. The packaging structure of claim 17, wherein the printable coating is a combination of clay and calcium carbonate.

19. The packaging structure of claim 1, wherein the second card and first card include a tear resistant material.

20. The packaging structure of claim 1, wherein the inner frame stiffener is formed of recycled chip board.

21. The packaging structure of claim 20, wherein the packaging structure is sealed using a heat sealing process.

22. The packaging structure of claim 1, wherein the inner frame stiffener has a thickness of about 40 to 60 points.

23. A method of forming a packaging structure comprising:

(a) positioning an inner frame stiffener between a first card and a second card, the inner frame stiffener having a frame stiffener opening therein;

(b) aligning an inner surface of the first card with a first surface of the inner frame stiffener;

(c) aligning an inner surface of the second card with a second surface of the inner frame stiffener;

(d) positioning a flange portion of a blister between the inner surface of the first card and the inner surface of the second card, the flange portion fitting entirely in the frame stiffener opening; (e) positioning an item into a body portion of the blister; and (f) sealing the first card to the second card

24. The method of forming the packaging structure of claim 23 further comprising aligning an edge of an opening in the first card with an edge of an opening in the inner frame stiffener.

25. The method of forming the packaging structure of claim 23, wherein the sealing of the first card to the second card is performed by a heat sealing process.

26. The method of forming the packaging structure of claim 25, wherein the inner frame stiffener is made of recycled chip board.

* * * * *